US009266384B2

(12) United States Patent
Van Os et al.

(10) Patent No.: US 9,266,384 B2
(45) Date of Patent: Feb. 23, 2016

(54) METHOD AND SYSTEM FOR MOUNTING A CANVAS OR SHEET SUBSTANTIALLY IN ONE PLANE

(75) Inventors: Clemens Leonard Van Os, Delft (NL); Ivan Suwandi Van Der Veld, Delft (NL)

(73) Assignee: Xpozer B.V., Delft (NL)

( * ) Notice: Subject to any disclaimer, the term of this patent is extended or adjusted under 35 U.S.C. 154(b) by 135 days.

(21) Appl. No.: 13/120,932

(22) PCT Filed: Sep. 28, 2009

(86) PCT No.: PCT/NL2009/050579

§ 371 (c)(1),
(2), (4) Date: May 11, 2011

(87) PCT Pub. No.: WO2010/036115

PCT Pub. Date: Apr. 1, 2010

(65) Prior Publication Data

US 2011/0210226 A1 Sep. 1, 2011

(30) Foreign Application Priority Data

Sep. 26, 2008 (NL) ..... 1035985

(51) Int. Cl.
*B44D 3/18* (2006.01)

(52) U.S. Cl.
CPC ..... *B44D 3/185* (2013.01); *Y10T 29/49947* (2015.01)

(58) Field of Classification Search
USPC ..... 160/374.1, 374, 381; 38/102.3
IPC ..... B44D 3/185
See application file for complete search history.

(56) References Cited

U.S. PATENT DOCUMENTS

| | | | | | |
|---|---|---|---|---|---|
| 1,042,284 | A | * | 10/1912 | Schenk | 38/102.8 |
| 1,227,577 | A | * | 5/1917 | Brewer | 160/374 |
| 1,393,616 | A | * | 10/1921 | Foster | 160/373 |
| 1,561,470 | A | * | 11/1925 | Kihm | 52/657 |
| 1,571,661 | A | * | 2/1926 | Descoteau | 160/373 |
| 1,916,023 | A | * | 6/1933 | Shull | 160/374.1 |
| 3,098,611 | A | * | 7/1963 | Connell | 40/714 |
| 3,448,551 | A | * | 6/1969 | Heller | 52/222 |
| 4,019,270 | A | | 4/1977 | Trowbridge | |
| 4,301,853 | A | * | 11/1981 | Vidal | 160/374.1 |
| 4,373,279 | A | | 2/1983 | Abel et al. | |
| 4,549,596 | A | * | 10/1985 | Staro | 160/374.1 |
| 4,635,700 | A | * | 1/1987 | Berger | 160/374.1 |
| 5,090,143 | A | | 2/1992 | Schier et al. | |
| 5,839,214 | A | * | 11/1998 | Peterson | 38/102.4 |

FOREIGN PATENT DOCUMENTS

| | | |
|---|---|---|
| AU | 536412 | 6/1984 |
| FR | 2078219 | 11/1971 |

* cited by examiner

*Primary Examiner* — David Purol
(74) *Attorney, Agent, or Firm* — Jordan IP Law, LLC; Todd A. Vaughn

(57) ABSTRACT

A system and method for mounting a length of material such as a canvas or sheet delimited by edges substantially in one plane. A plurality of engagement members is attached on the back of the canvas or sheet adjacent corners of the canvas or sheet between two edges or along two opposite edges thereof. These engagement members are forced apart by fitting one or more mounting members in between.

18 Claims, 5 Drawing Sheets

METHOD AND SYSTEM FOR MOUNTING A CANVAS OR SHEET SUBSTANTIALLY IN ONE PLANE

CROSS REFERENCE TO PRIOR APPLICATIONS

The present application is a National Stage Application of PCT International Application No. PCT/NL2009/050579 (filed on Sep. 28, 2009), under 35 U.S.C. §371, which claims priority to the Netherlands Patent Application No. 1035985 (filed on Sep. 26, 2008), which are each hereby incorporated by reference in their respective entireties.

FIELD OF THE INVENTION

The invention relates to a method for mounting a canvas or sheet delimited by edges substantially in one plane. Furthermore, the invention relates to a mounting system for mounting such a canvas or sheet delimited by edges substantially in one plane.

BACKGROUND OF THE INVENTION

A mounted canvas or sheet, the object of which is to show an image on the image side thereof, such as a poster, a photograph, a thin (roll-up) screen, a projection screen and the like, should preferably remain flat during use.

One problem when mounting such a canvas or sheet is the fact that the latter cannot easily be mounted so that it is truly flat. Every canvas or sheet has a tendency to curl along the edges when it is being mounted. This is due to the fact that the tension along the edges is lower than in the centre, resulting in the edges between the corners being slack. Thus, the edges may start to curl or flap. Wrinkling also occurs easily and a conventionally mounted canvas or sheet is sensitive to external factors, such as pressure, temperature and humidity, as a result of which the canvas or sheet may deform. Partly due to this, the canvas or sheet is not perfectly flat, despite having been mounted.

SUMMARY OF THE INVENTION

It is now an object of the invention to provide a mounting method which solves this problem, or at least lessens it, without affecting the appearance of the canvas or sheet. In this context, the term appearance is understood to mean the image side of the canvas or sheet, which is understood to be that side on which the image to be shown is provided. To this end, the invention provides a method for mounting a canvas or sheet delimited by edges essentially in one plane, comprising attaching a plurality of engagement members on the back of the canvas or sheet in the vicinity of corners between two edges and fitting at least one mounting member in between. By providing engagement members and mounting member (s) on the back, it is ensured in this case that the entire canvas or sheet remains visible, and no parts of the image are obstructed. More specifically, the entire image side of the canvas or sheet remains visible.

As described above, the canvas or sheet comprises an image side and a back. The canvas or sheet may be formed by a plane delimited by edges. The canvas or sheet may, for example, comprise four edges. If the canvas or sheet has a rectangular shape, this implies the presence of two relatively long edges and two relatively short edges which are at a right angle to one another. According to one embodiment, the method comprises attaching the plurality of engagement members along opposite edges of the canvas or sheet, for example the short edges. By attaching engagement members at opposite edges, mounting becomes simpler, in particular in the case of a rectangular canvas or sheet.

To this end, an engagement member is provided which has a substantially elongate shape and has movable and/or length-adjustable components and is furthermore designed to act on the canvas or sheet at certain positions.

Each engagement member can extend substantially along the entire length of the respective edge of the canvas or sheet. In this case, each engagement member can only engage with the canvas or sheet at its ends, or possibly be attached to the respective edge of the canvas or sheet along substantially the entire length thereof. Thus, curling of the respective edge of the rectangular canvas or sheet is prevented by the stiffness of the engagement member.

If each engagement member is designed such that it exerts a greater tensile force on the corners than on the edge situated in between, then it is possible to prevent curling of the edges between opposite engagement members to a large degree. This also includes the situation where the engagement members are not directly attached to the edges and therefore do not exert any direct tensile force on the edges, since the additional tensile force on the corners leads to additional tension in the edges between these corners.

Each engagement member may have at least one main segment extending along a central part of the respective edge of the canvas or sheet and at least two corner segments on either side of the main segment extending up to the corners. In one embodiment of the mounting system, the corner segments may be movable in the plane with respect to the main segment, while movement in a direction at right angles to the plane is limited. According to one embodiment, the method furthermore comprises attaching the corner segments to the back of the canvas or sheet, and the subsequent forcing apart of the corner segments. In this case, the main segment can also be attached to the back of the canvas or sheet, but this is not essential.

The corner segments of each engagement member may be forced apart outwardly substantially in the plane of the canvas or sheet. In this case, the corner segments of each engagement member may be forced apart substantially parallel to the respective edge. In an alternative embodiment of the mounting system, each engagement member may be designed to exert a tensile force on the corners, directed outwardly substantially in the plane in a direction at an angle with respect to an edge. This makes it possible to achieve an optimum distribution of stress along all the edges of the canvas or sheet.

Experiments and analyses show that, for a rectangular canvas or sheet, the smallest angle which the tensile force makes with an edge preferably has a value in the range between 40° and 50°, so that the canvas or sheet can be mounted correctly in the plane. In this case, a smallest angle $\alpha$ of 45° is particularly preferred.

In order to be able to position the engagement members of corner segments accurately along the edges, they may first be releasably attached to the canvas or sheet and only then be attached permanently thereto.

Alternatively, a simple and accurate positioning of the engagement member can be achieved by providing each corner segment with a first attachment part which is connected to the main segment and a second attachment part which can be connected to the first attachment part. In such an embodiment of the mounting system, a further embodiment of the method may furthermore comprise attaching the second attachment part to a corner on the back of the canvas or sheet, and attaching the second attachment part to the first attachment part. The second attachment part may, for example, be attached to the corner using an adhesive as fixing means. Depending on the adhesive, this attachment may be releasable or permanent. By adding such attachment parts, mounting of the canvas or sheet by means of the mounting system is simpler and it can, in addition, be removed with less risk of damage to the canvas or sheet.

Each engagement member may be adjustable in length. In one embodiment, the method in this case comprises adjusting each engagement member to the desired length after the first attachment parts have been attached to the second attachment parts. The at least one mounting member may also be adjustable in length, so that the length of the at least one mounting member can be adjusted to a desired length after it has been attached between the engagement members. By providing the mounting system with engagement members and/or mounting members which are adjustable in length, such an embodiment of the mounting system can be used for mounting canvasses or sheets of different dimensions.

In a further embodiment, the mounting system may furthermore be provided with a suspension member for the releasable attachment of the mounting system to a supporting structure. Thus, the canvas or sheet can be attached to a background or base. It can also be hung on, for example, a vertical wall, with the back facing the wall. Just like the engagement members and the at least one mounting member, this suspension member may be provided on the back of the canvas or sheet, as a result of which the canvas or sheet can be fixed with the back to an attachment means, such as a suspension wire, a wall or a rack, so as to be virtually flat and completely visible on the image side.

Finally, the invention also relates to an engagement member and a corner segment of an engagement member for use with a method and a mounting system as described above.

BRIEF DESCRIPTION OF THE DRAWINGS

Embodiments of the invention will be described below, solely by way of example, with reference to the accompanying diagrammatic drawings, in which identical parts are denoted by identical reference symbols and in which.

The drawings are only intended for illustrative purposes, and are not intended to limit the scope of protection which is defined by the claims.

DETAILED DESCRIPTION OF THE INVENTION

Figure 1:
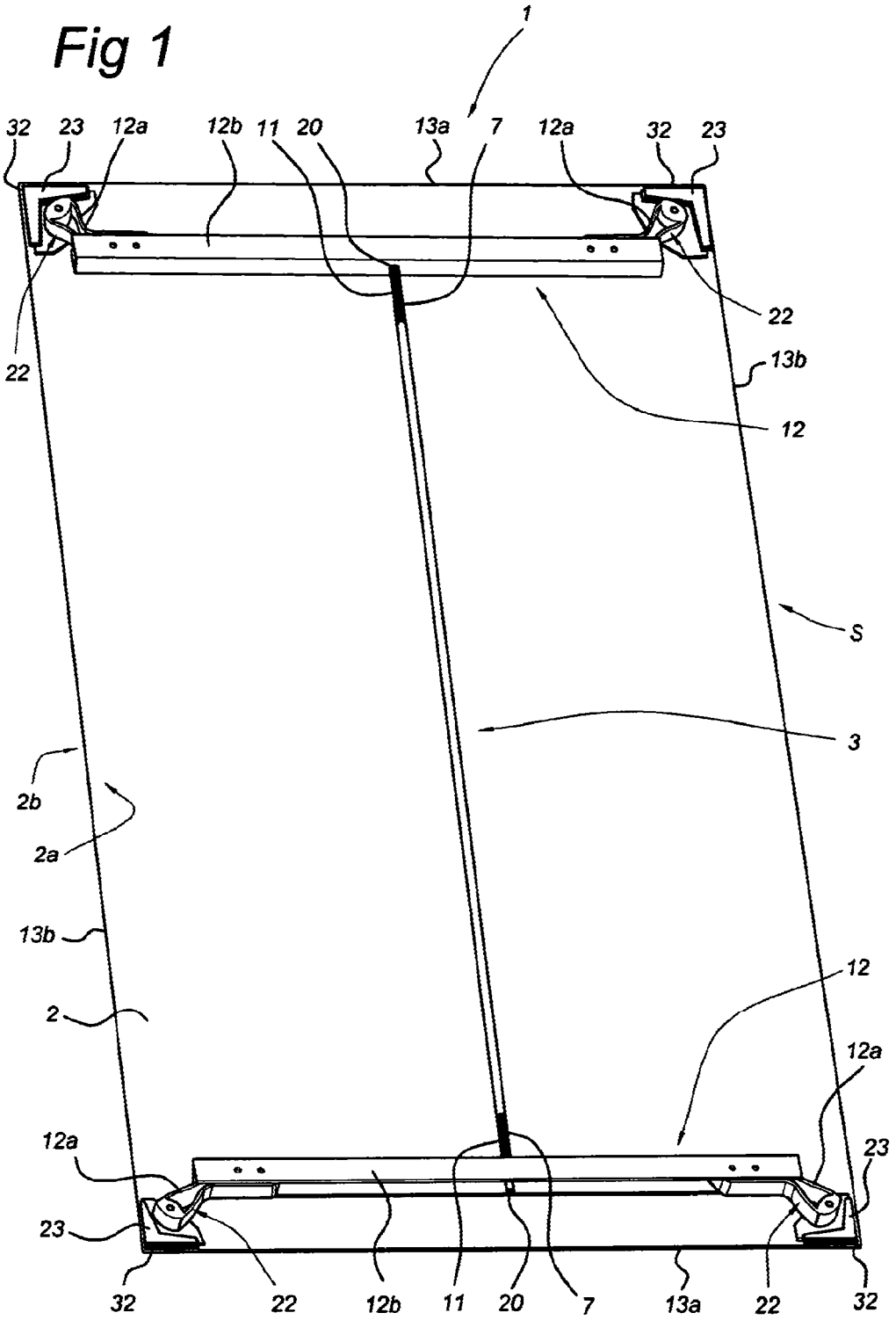
FIG. 1 shows a diagrammatic perspective view of a mounting system according to one embodiment.

The invention provides a method and mounting system 1 for mounting a canvas or sheet 2 delimited by edges 13 substantially in one plane. In FIG. 1, an embodiment of the mounting system 1 is shown which is suitable for mounting a canvas or sheet 2 which is delimited by two long edges 13*b* and two short edges 13*a*. This mounting system 1 comprises two engagement members 12, which can each be attached to the back 2*a* of the canvas or sheet 2, virtually out of sight viewed from the image side 2*b*. To this end, an engagement member 12 has a substantially elongate shape and may have movable and/or length-adjustable components. In addition, the engagement member 12 is designed to engage with the canvas or sheet 2 at certain positions. Furthermore, the mounting system 1 comprises at least one mounting member 3, which can be arranged between the engagement members 12. The at least one mounting member 3 serves to keep the engagement members 12 at a virtually fixed position with respect to one another, during use of the mounting system 1 when keeping the canvas or sheet 2 mounted.

Each engagement member 12 can extend along substantially the entire length of a respective edge 13 of the canvas or sheet. In this case, each engagement member 12 may only act on the ends of the canvas or sheet 2.

An engagement member 12 may be supplied in the form of a relatively long profiled-section part, and be adjusted to any desired length by means of cutting, if desired in combination with breaking. An engagement member 12 can also be supplied shortened to size. In addition, or alternatively, each engagement member 12 may be adjustable in length, for example because it comprises mutually displaceable and/or telescopic components.

Figure 4:
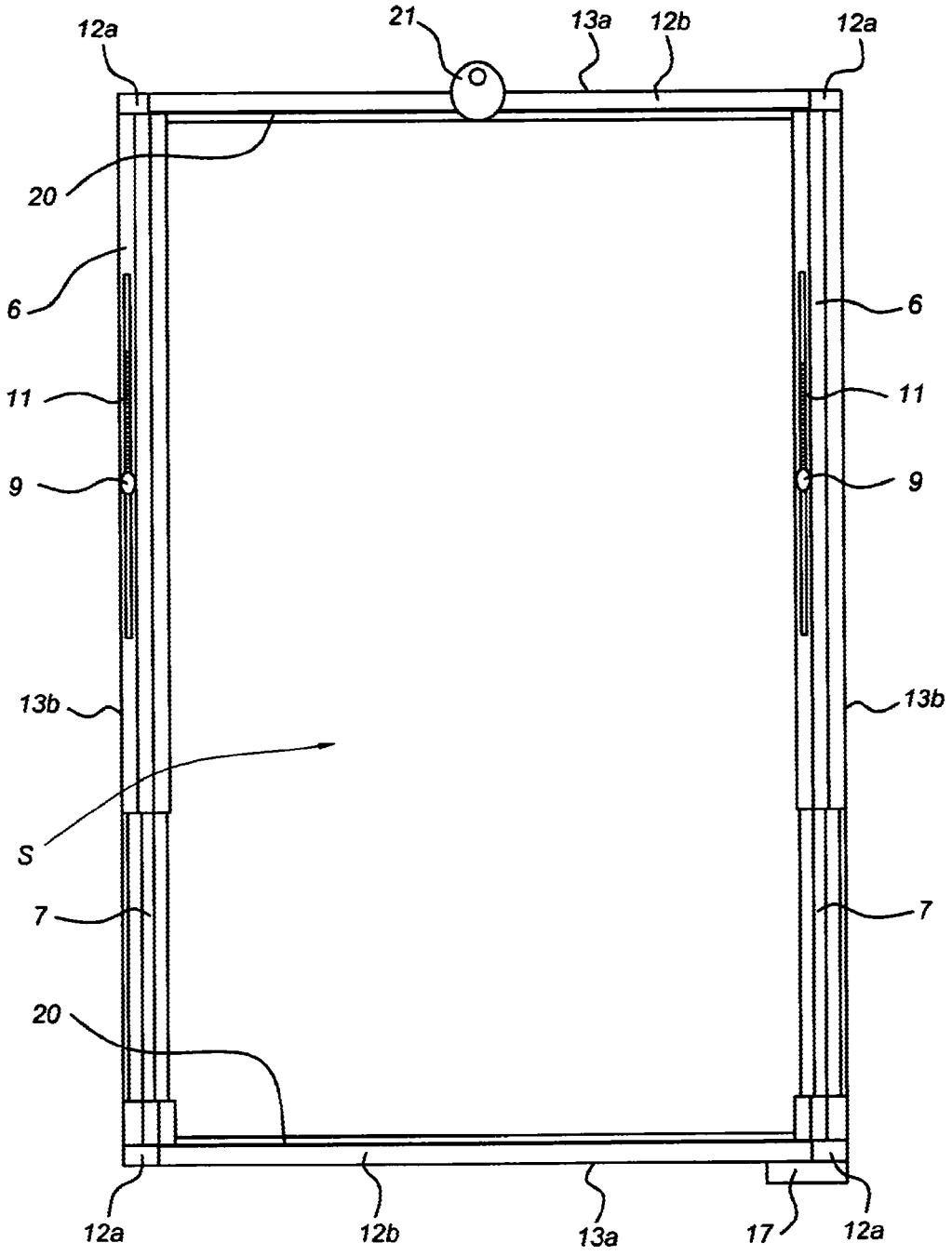
FIG. 4 shows a mounting system according to another embodiment.

The at least one mounting member 3 may, in addition, also be adjustable in length. This can be achieved in a simple manner if the at least one mounting member 3 has a base part 6 and at least one part 7 which is displaceable thereto, for example a telescopic part 7. These elements are represented in FIG. 4. As a result thereof, a mounting member 3 of such a design can be used with canvasses or sheets 2 of different dimensions. In addition, fixing means 9 may be present by means of which each mounting member 3 can be fixed at a set length. These fixing means 9 may, for example, be formed by a crossing member which has an aperture through which the telescopic part 7 extends. The fixing means may also be designed as a simple adjusting screw 9. The mounting member 3 may then be tensioned during installation by means of a spring element 11.

In the embodiment of the mounting system as illustrated in FIG. 1, the mounting member 3 may be tensioned by means of two spring elements 11 which are provided around the telescopic ends 7 after the two illustrated telescopic ends 7 have been inserted in holes 20 in the engagement members 12.

The stiffness properties of the engagement members 12 and the at least one mounting member 3 have to be such that any possible deformation of the entire mounting system 1 can approximately have only a very small component in a direction perpendicular to the plane S of the canvas or sheet compared to the characteristic dimensions of the canvas or sheet. A perpendicular deformation which is typically allowed is a few millimeters for a canvas or sheet with dimensions in the order of magnitude of (half) meters.

As is illustrated in FIGS. 1 and 4, each engagement member 12 may be formed by a main segment 12*b* with two corner segments 12*a* on either side which are movable with respect to the main segment 12*b*, transversely to a longitudinal axis of the engagement member 12. The corner segments 12*a* may in this case be movable both in the direction of the long edges 13*b* and in the direction of the short edges 13*a*. This movability has to correspond to a large degree to the plane S in which the canvas or sheet 2 is to be mounted. In this case, the movability in a direction at right angles to the plane S has to be limited. Such a movability may, for example, be achieved by means of a hinge mechanism with an axis of rotation which is perpendicular to the plane S of the canvas or sheet 2. At the same time, such a hinge also limits the movability perpendicular to the plane S. Such movability can also be achieved by fitting an anisotropically elastic element, such as a double film hinge 31 illustrated in FIG. 2. Such an anisotropically elastic element may have significant flexibility in one plane, while movement of the anisotropically elastic element in a direction perpendicular to this plane is subject to significantly more resistance.

Figure 2:
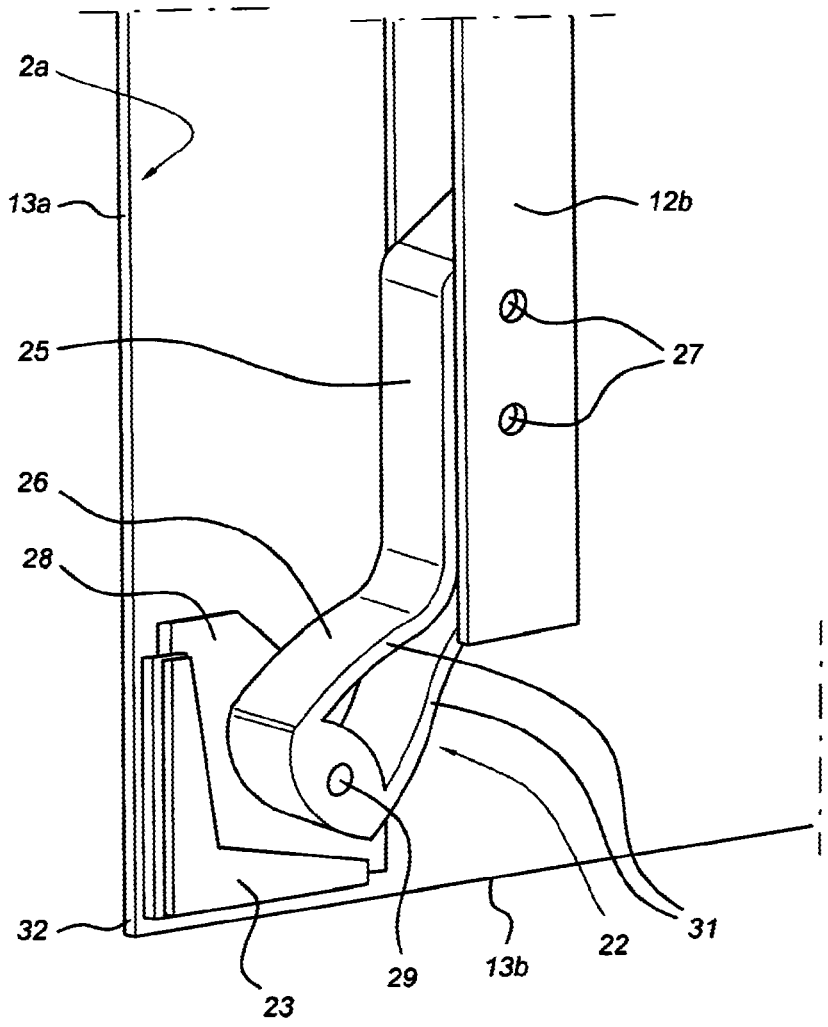
FIG. 2 shows a corner segment of an engagement member according to an embodiment of the mounting system.

According to one embodiment of the mounting system 1, each corner segment 12*a* of an engagement member 12 may be provided with a first attachment part 22 and a second attachment part 23. This is illustrated in FIG. 2. The second attachment part 23 may in this case be attachable to a corner 32 on the back 2*a* of the canvas or sheet 2 and forms a component which is detachable from the engagement member 12. The first attachment part 22 is connected to the main segment 12*b* and may be releasably attachable to the second attachment part 23. As is illustrated in FIG. 2, the first attachment part 22 may comprise a base 25 and a projecting part 26. The base 25 may be connected to the engagement member 12 by means of at least one attachment pin 27. Here, the projecting part 26 comprises an insertion part, which may be in the form of a flattened pointed insertion part 28. The second attachment part 23 may essentially consist of a receiving part 23 which is partly shaped like the corner 32 on the back 2*a* of the canvas or sheet 2. The receiving part 23 may in this case comprise a recess having a shape which largely corresponds to the insertion part 28 of the first attachment part 22, so that the receiving part 23 can receive the projecting part 26. Both the recess in the receiving part 23 and the insertion part 28 may in this case comprise a virtually right angle, as is illustrated in FIG. 2. As a result of the receiving part 23 being shaped in this way, an insertion part 28 which is fixed therein can only move to a very limited degree in a direction perpendicular to the plane S.

Between the base 25 and the projecting part 26 of a corner segment 12*a*, a hinge 31 may be provided, as can be seen in FIG. 2. As a result thereof, a corner segment 12*a* can be hinged with the main segment 12*b*. The hinge 31 may be provided with a spring mechanism which can exert a spring force in a plane which is directed opposite to the angular deflection between the corner segment 12*a* and the main segment 12*b*. The spring properties of such a hinge can be realised by designing the hinge as a double film hinge 31. Incidentally, the same effect can also be achieved in a different manner, for example by means of a conventional hinge or a so-called "rolling joint".

In addition, a corner segment 12*a* may be provided with a second hinge point by securing projecting part 26 and insertion part 28 rotatably with respect to one another by means of a connecting pin 29.

By providing each corner segment 12*a* with two hinge points, a desired distribution of the tensile forces which the mounting system exerts on the corner 32 during mounting of the canvas or sheet 2 can be achieved. This is explained in more detail below with reference to FIG. 3.

According to an alternative embodiment of the mounting system 2, a second hinge point can also be achieved by designing the insertion part 28 to be pointed with an angle of less than 90°, and by providing the receiving part 23 with a recess with an angle which is greater than the angle of the insertion part. When the associated engagement member 12 is tensioned, the corner of the insertion part 28 which is pushed into the receiving part 23 will come to lie in the corner of the receiving part. As a result thereof, an attachment between receiving part 23 and insertion part 28 is achieved which is rotatable about these coinciding corners, but detachable. The first hinge point can then still be formed by hinge 31. The pivoting connecting pin 29 between projecting part 26 and insertion part 28 can thus be omitted, so that these parts form a single part.

In one embodiment of the method for mounting the canvas or sheet, each receiving part 23 can be attached in a releasable or permanent manner to the canvas or sheet 2, for example by means of an adhesive as fixing agent. Such an adhesive may be covered with a protective covering film when it is not being used. The receiving parts 23 may first be put on the corner 32 near the edges 13 of the canvas or sheet 2 and temporarily be attached thereto, for example by means of a strip of non-permanent adhesive. If a receiving part 23 is not positioned completely correctly, it can be removed again.

If a receiving part 23 has been placed in a desired position in the corner 32 on the back 2*a* of the canvas or sheet, this receiving part 23 can be attached permanently, for example by removing the protective cover film from a strip of permanent adhesive on one side of the receiving part 23 and by pressing this strip of adhesive into the corner 32 on the back 2*a* of the canvas or sheet 2. Only after receiving parts 23 have been permanently attached to the corners 32 are insertion parts 28 of the corner segments 12*a* inserted into the receiving parts 23. Subsequently, the respective engagement member 12, of which the corner segments 12*a* form a part, can be adjusted to the correct length, so that the canvas or sheet is tensioned in the corners 32 corresponding to the corner segments 12*a*.

Instead of providing separate permanent and non-permanent adhesive strips, it is also conceivable to use only one type of adhesive, which is covered by a cover film consisting of two parts. It is then possible to first form a non-permanent connection by removing a relatively small part of the cover film, as a result of which only a narrow strip of adhesive is exposed, and the adhesion is therefore still low. If the receiving part 30 is correctly positioned, then the remaining larger part of the cover film can be removed and the complete surface of the adhesive can be exposed, as a result of which a permanent bond is achieved. Since the loads at the corners 32 will be greater than along the edges 13, the strength of the connection between the engagement member 12 and the canvas or sheet 2 can vary. Thus, a strip of adhesive at the corners 32 could be wider than at locations which are further removed from a corner.

If the engagement members 12 or at least the receiving parts 23 are attached to the canvas or sheet 2 using a permanent fixing agent, then they will eventually be stored or disposed of together with the canvas or sheet 2.

The at least one mounting member 3 which is to be fitted between the engagement members 12 can be placed in a receiving space 20 which is provided in the engagement member 12. The ends of each mounting member 3 may be designed to be fittingly accommodated in the receiving space 20.

The engagement members 12 and the mounting members 3 may in this case be designed to connect mounting members 3 to one another at a predetermined position, so as to be releasable. In FIG. 1, for example, a receiving space 20 is provided in the centre of each engagement member 12. The underlying idea is that a user automatically connects the mounting members 3 to the engagement members 12 in the correct manner and location. To this end, each engagement member 12 has a receiving space 20 which extends over for a relatively short length, for example just sufficient to accommodate the mounting member 3.

The shape of the receiving space 20 and the cross section of the end of each mounting member 3 may be chosen such that these two parts are in form-fitted contact. In that case, the profile of the engagement member 12 only fits one specific type of mounting member 3.

Figure 5:
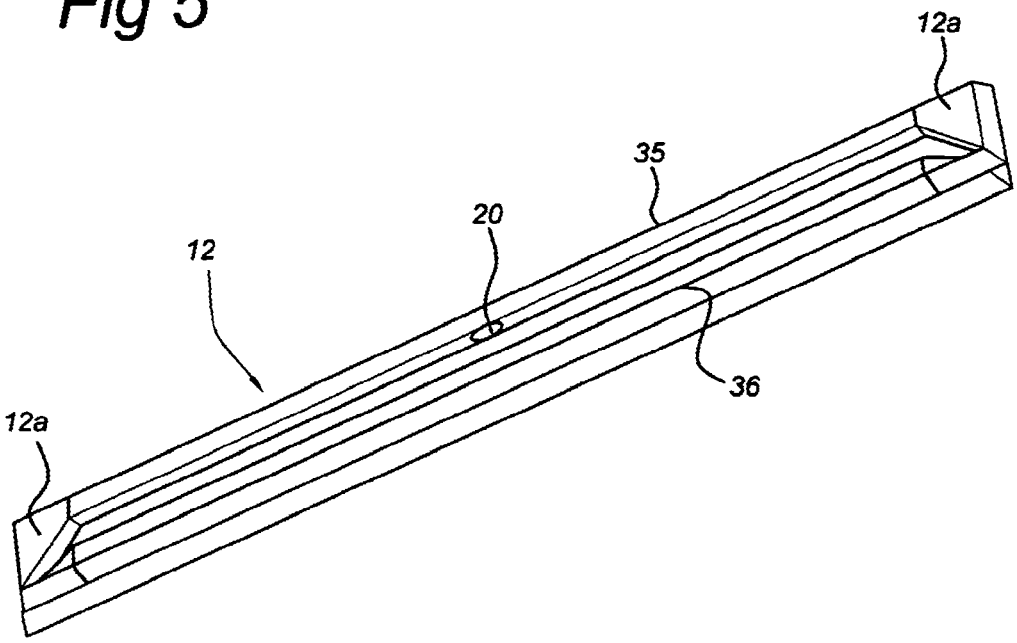
FIG. 5 shows an engagement member of a mounting system according to a further embodiment.

As is illustrated in FIG. 5, in an alternative embodiment of the mounting system 1, the engagement member 12 may have an open side in the length direction with the receiving space 20 which extends along the entire length of the engagement member 12 and in which ends of mounting members 3 can be accommodated. The contact between the engagement member 12 and the mounting member 3 may at least be a form-fitted surface contact or line contact in order to prevent twisting about the longitudinal axis and lateral displacements of the engagement members 12, since this could result in the canvas or sheet 2 being pulled out of alignment.

The twisting effect is prevented in particular by providing an embodiment with several mounting members 3 which can be arranged between the engagement members 12, as is shown in FIG. 4.

The at least one mounting member 3 can be connected to the engagement members 12 in a substantially symmetrical way, thus resulting in an even distribution of the tensile forces and preventing the risk of twisting of the canvas or sheet 2 about a longitudinal axis. This situation is illustrated both in FIG. 1 and in FIG. 4.

If exactly one mounting member 3 is used, then the contact point or the contact line between the engagement member 12 and the mounting member 3 can be chosen to be close to the centre of the opposite engagement members 12, as is illustrated in FIG. 1. Such an embodiment has the advantage that only one mounting member 3 is required and thus is a lighter and less expensive embodiment.

Figure 3:
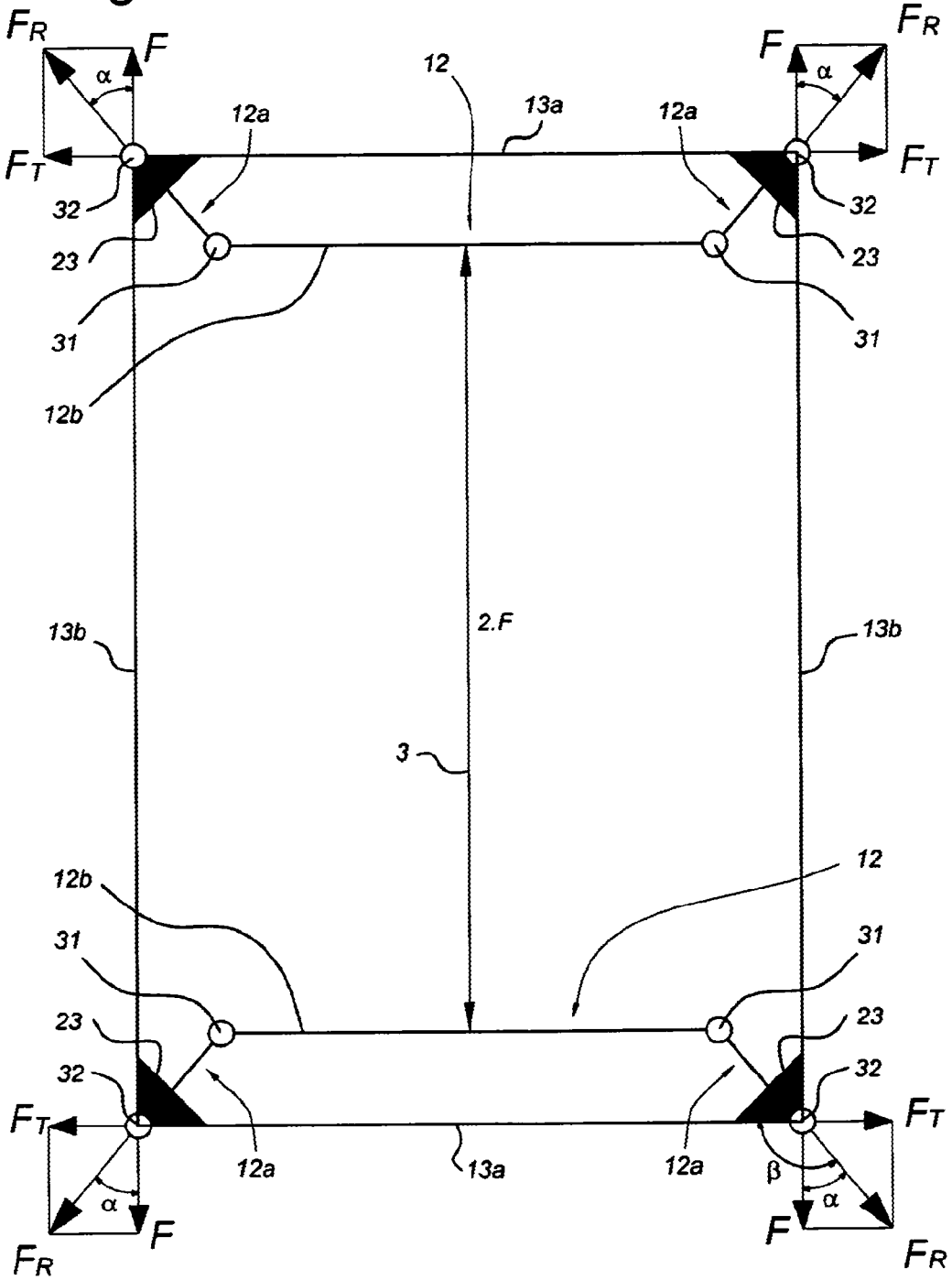
FIG. 3 diagrammatically shows how tensile forces are exerted on the canvas or sheet according to one embodiment of the mounting method.

By using the mounting member 3, the engagement members 12 are forced apart by a tensile force 2·F, illustrated in FIG. 3. This force is passed on to the two corner segments 12*a* by the flexurally stiff main segment 12*b* of each engagement member 12. Due to the fact that the ends of the corner segments are attached to the corners 32 of the canvas or sheet 2, they transfer a tensile force F to the corners 32 of the canvas or sheet 2. This force has to be mainly in the plane S of the canvas or sheet 2 and is directed outwards. As the corner segments 12*a* can move with respect to the main segment 12*b* substantially within the plane, they will assume a new equilibrium position subject to the tensile forces. In this case, the corner segments act as distributors of this tensile force F. This takes place in such a manner that a resultant compressive force $F_T$ is exerted on the corners 32 in the direction parallel to the longitudinal axis of the engagement member 12 and that furthermore a compressive force F is exerted in the direction of the mounting member 3. Thus, the short edges 13*a* of the canvas or sheet 2 are loaded by the force $F_T$ which forces the corners 32 apart, while the long sides 13*b* are loaded by the force F. As a result of this stress, deformation of the edges 13 perpendicular to the plane of the canvas or sheet 2, which results in, for example, curling or wrinkling, is prevented. In this case, the ratio between the force on the short edge 13*a* and that on the long edge 14 is determined by the design of the engagement member 12, in particular the stiffness of the main segment 12*b* and the shape and flexibility of the corner segments 12*a*. It has been found that a smooth shape of both the short edges 13*a* and the long edges 13*b* can be achieved when the transverse force $F_T$ is approximately equal to the tensile force F, so that the resultant force $F_R$ of these forces makes a smallest angle $\alpha$ of approximately 40°-50°, with this smallest angle $\alpha$ being interpreted as the acute angle which the resultant force $F_R$ makes with a line parallel to one of the edges 13. In this case, a smallest angle $\alpha$ of approximately 45° is preferred, so that the tensile force components in both directions are in this case equal. In the example illustrated in FIG. 3, such a preference for the smallest angle $\alpha$ results in a supplementary angle $\beta$ of 135° counterclockwise or clockwise with respect to either a short edge 13*a* or a long edge 13*b*, depending on the orientation of the respective edge 13, also illustrated in FIG. 3.

However, the angle at which tensile forces can act on corners 32 of the canvas or sheet 2 should not be understood to be limited to the abovementioned range. Other values for the smallest angle $\alpha$ are obviously possible and are only limited by the fact that the tensile force has to be directed outwardly substantially in the plane of the canvas or sheet. The requirement of having to be directed outwardly in the plane is in this case determined by the shape of the canvas or sheet.

FIG. 4 shows an alternative embodiment of the mounting system 1. According to this embodiment, the engagement members 12 are designed to be attached along the short edges 13*a* and may each be approximately as long as this short edge 13*a*. Furthermore, two mounting elements 3 are provided which are arranged along the long edges 13*b* of the canvas or sheet 2. Here, the engagement member 12 is formed by a profiled section having an open side. This open side defines a receiving space 20 which, in this variant, extends along the entire length of the engagement member 12 and in which the ends of the mounting members 3 are accommodated. In this embodiment, the contact between the engagement member 12 and each mounting member 3 has to be at least a form-fitted surface contact or line contact in order to prevent twisting about the longitudinal axis and lateral displacements of the engagement members 12, since this could result in the canvas or sheet 2 being pulled out of position. The contact point or the contact line between the engagement member 12 and the mounting member 3 will be relatively close to the canvas or sheet 2. Therefore, the force exerted by the mounting members 3 results in only a very slight bending moment transversely to the plane of the canvas or sheet 2. This moment is absorbed by the stiffness of the engagement member 12.

Incidentally, the base part 6 and the displaceable part 7 of the mounting member 3 may have a non-rotationally symmetrical, for example rectangular, cross section. This prevents the displaceable part 7 and the base part 6 and their respective ends from being able to twist with respect to one another, which could result in deformation or displacement of the engagement members 12 and thus to deformation of the mounted canvas or sheet 2.

In an alternative embodiment of the mounting system, each engagement member 12 consists of a first and a second profiled section 35, 36 which may run parallel and only be connected to one another at their ends by corner segments 12*a*. An engagement member 12 according to this embodiment is illustrated in FIG. 5. In this case, the second profiled section 36 is accommodated in the receiving part 23 which in this case is in the form of an flanged frame which extends along the entire edge 13 of the canvas or sheet 2. This receiving part 23 may actually be attached to the canvas or sheet 2 only in the corners 32.

Finally, the mounting system 1 may also comprise a suspension member 21 for releasably attaching the mounting system 1 to a supporting structure. Thus, the canvas or sheet can be attached to a background or base. It can, for example, be hung on a vertical wall, with the back facing the wall. Just like the engagement members 12 and the at least one mounting member 3, this suspension member 21 may be provided on the back 2*a* of the canvas or sheet 2, as a result of which the canvas or sheet 2 can be fixed with the back 2*a* to an attachment structure, such as a suspension wire, a wall or a rack, so as to be virtually flat and completely visible on the image side 2*b*.

This suspension member 21 may, for example, be provided with a layer of non-permanent adhesive 23. Incidentally, an opening may also be formed in the suspension member 21 in order to receive, for example, a nail, screw or hook which is already present in the wall 22. Such an opening is shown in FIG. 5. In the illustrated example, the suspension member 21 cooperates with the upper engagement member 12, and is shaped in such a way that its straight top edge can extend into a receiving space 20 which is provided along the entire length of the engagement member 12, as a result of which the mounting system 1 together with the canvas of sheet 2 mounted therein can be hung in a stable and straight manner. Of course, the engagement member 12 may also comprise an opening which has been purpose made for the suspension member 21 or another attachment means. This suspension member may be designed such that the canvas or sheet can be hung at any desired orientation. Common orientations for a rectangular canvas or sheet in this case are a vertical "portrait" orientation and a horizontal "landscape" orientation.

Alternatively, the suspension member 21 can be designed such that the backs 2*a* of the two mounting systems 1 can be positioned back to back, with it being possible to attach the combination to a suspension point which is situated at a relatively high level, for example by means of a suspension wire.

Since the engagement members 12 and the at least one mounting member 3 of the mounting system 1 are completely attached to the back 2*a* of the canvas or sheet 2, the canvas or sheet 2 becomes slightly detached from the base on which it is hung, which results in a spatial effect in the form of a cast shadow.

Between an engagement member 12 and the canvas or sheet 2, an information carrier 17 may furthermore be provided. This information carrier 17 may be designed such that it forms the only component of the mounting system 1 which is visible on the image side 2*b* of the canvas or sheet 2, once the system has been attached to, for example, a wall.

Although the invention has been described above with reference to two examples, it will be clear that it is not limited thereto. Thus, the shape and dimensions of the engagement members and the mounting members could be varied in many different ways. For example, two or more shorter engagement members could be arranged next to one another along an edge of the canvas or sheet. The way in which the length of the engagement members and mounting members is adjusted and the way in which the mounting members are connected to the engagement members may be chosen differently than has been illustrated and described here. The scope of the invention is therefore solely determined by the attached claims.

LIST OF REFERENCE NUMERALS

1 Mounting system
2 Canvas or sheet
2*a* Back
2*b* Image side
3 Mounting member
6 Base part
7 Displaceable part
9 Adjusting screw
11 Spring element
12 Engagement member
12*a* Corner segment
12*b* Main segment
13 Edge
13*a* Short edge
13*b* Long edge
20 Receiving space
21 Suspension member
22 First attachment part
23 Second attachment part (receiving part)
25 Base
26 Projecting part
27 Attachment pin
28 Insertion part
29 Connecting pin
31 Hinge
32 Corner
35 First profiled section
36 Second profiled section
S Plane
F Tensile force in length direction
$F_T$ Tensile force in width direction
$F_R$ Resultant tensile force
α Smallest angle
β Supplementary angle

What is claimed is:

1. A method of mounting a sheet with an image side and a back side delimited by lateral and longitudinal edges substantially in one plane with a plurality of engagement members which each comprise at least two corner segments and at least one main segment extending between the two corner segments, the method comprising:

attaching a plurality of engagement members to the back side of the sheet at least in a vicinity of corners of the sheet between the edges of the sheet by attaching the at least two corner segments to the back of the sheet in the vicinity of the corners such that the at least two corner segments do not extend through the sheet, and forcing the at least two corner segments apart by extending the main segment of the engagement member between the at least two corner segments; and then forcing the plurality of engagement members spatially apart by fitting at least one mounting member between the plurality of engagement members.

2. The method of claim 1, wherein attaching the plurality of engagement members comprises attaching the plurality of engagement members along opposite edges of the sheet.

3. The method of claim 2, wherein each one of the plurality of engagement members extends substantially along an entire length of a respective edge of the sheet.

4. The method of claim 1, wherein forcing the corner segments apart comprises forcing the corner segments apart outwardly substantially in the plane.

5. The method of claim 1, wherein each corner segment comprises: a first attachment part configured for connection to the main segment; and a second attachment part configured for connection to the first attachment part.

6. The method of claim 5, further comprising: attaching the second attachment part to a corner of the back side of the sheet; and then attaching the first attachment part to the second attachment part.

7. The method of claim 6, further comprising: adjusting the length of each engagement member to a desired length after the first attachment part has been attached to the second attachment part.

8. The method of claim 1, further comprising: adjusting the length of the at least one mounting member to a desired length after forcing the plurality of engagement members spatially apart.

9. A system for mounting a sheet with an image side and a back side delimited by lateral and longitudinal edges substantially in one plane, the system comprising: a plurality of engagement members configured for attachment to a back side of the sheet at least in the vicinity of corners of the sheet between the edges of the sheet and such that they do not extend to an image side of the sheet; and at least one mounting member configured for placement between the plurality of engagement members.

10. The system of claim 9, wherein each one of the plurality of engagement members is configured to extend substantially along a respective edge of the sheet.

11. The system of claim 9, wherein each one of the plurality of engagement members is configured to exert a resultant tensile force on the corners of the sheet, such tensile force being directed outwardly substantially in the plane in a direction at a smallest angle with respect to the respective edge of the sheet.

12. The system of claim 11, wherein the smallest angle has a value in a range of between 40° and 50°.

13. The system of claim 9, wherein each one of the plurality of engagement members comprises: at least one main segment extending along a central part of the respective edge of the sheet; and at least two corner segments on either side of the main segment adjacent a respective corner of the sheet.

14. The system of claim 13, wherein the at least two corner segments are configured for movement in the plane with respect to the main segment while also having limited movement in a direction at right angles to the plane.

15. The system of claim 14, wherein each of the at least two corner segments comprises: a first attachment part configured for connection to the at least one main segment; and a second attachment part configured for connection to the first attachment part and a corner on the back side of the sheet.

16. The system of claim 9, wherein each one of the plurality of engagement members is adjustable in length.

17. The system of claim 15, wherein the at least one mounting member is adjustable in length.

18. The system of claim 9, wherein each engagement member is fixed to the back side of the sheet with adhesive.

* * * * *